United States Patent [19]

Marshall

[11] 4,191,222

[45] Mar. 4, 1980

[54] WEFT PRESENTER MECHANISMS

[75] Inventor: Brian Marshall, Keighley, England

[73] Assignee: Macart Textiles (Machinery) Limited, Bradford, United Kingdom

[21] Appl. No.: 881,938

[22] Filed: Feb. 28, 1978

[51] Int. Cl.[2] ..... D03D 47/38

[52] U.S. Cl. ..... 139/453

[58] Field of Search ..... 139/66 R, 67, 69, 70, 139/437, 453

[56] References Cited

U.S. PATENT DOCUMENTS

| | | | |
|---|---|---|---|
| 3,092,150 | 6/1963 | Brimans | 139/453 |
| 3,548,886 | 12/1970 | Scherillo | 139/453 |

FOREIGN PATENT DOCUMENTS

| | | | |
|---|---|---|---|
| 458695 | 7/1950 | Italy | 139/453 |

*Primary Examiner*—Henry Jaudon
*Attorney, Agent, or Firm*—John C. Smith, Jr.

[57] ABSTRACT

A weft presenting mechanism for use with looms having a stationary weft supply in which individual weft yarns are selectively moved into position to be picked up by the weft inserting mechanism and inserted into a warp shed. The device includes a plurality of weft presenting fingers and a drive means, all pivoted about a common axis.

9 Claims, 3 Drawing Figures

WEFT PRESENTER MECHANISMS

BACKGROUND TO THE INVENTION

The invention relates to weft presenting mechanism for use in looms.

DESCRIPTION OF THE PRIOR ART

Weft presenting mechanisms are known for use in presenting a weft yarn to a picking device of a loom, such as the giver rapier of a rapier loom. The mechanism moves a weft yarn into the path of the rapier so that the rapier can pick up the weft yarn and carry it into the shed of the loom. Known mechanisms comprise a finger having an eyelet through which a weft yarn is threaded, the finger being movable when necessary to move the weft yarn into the path of the rapier. Generally there are a plurality of fingers, each having a different weft yarn threaded therethrough, and the fingers are selectively operable so that any desired finger may be moved to present the weft yarn threaded therethrough.

Motion is imparted to the fingers by a part of the loom which is moving in synchronism with the main drive shaft of the loom but since the fingers are selectively operable, only one finger being moved for any one pick of the loom, a plurality of connecting members are provided, one for each finger, these connecting members being selectively operable to connect any desired finger to the said moving part of the loom so that that finger will receive a driving force causing it to present its associated weft yarn to the rapier.

Known mechanisms have a large number of parts which perform movement relative to one another, rubbing on one another, and are hence subject to considerable wear, particularly bearing in mind the very high picking speeds of modern looms. Many modern looms operate at several hundred picks per minute and as each pick involves the movement of one finger and its associated connecting member and the drive member, very considerable wear can result.

OBJECT OF THE INVENTION

It is the object of the invention to provide a weft presenting mechanism which has fewer moving parts than known mechanisms and is less subject to wear.

SUMMARY OF THE INVENTION

According to the invention, a weft presenting mechanism for use on a loom comprises:

(a) A plurality of fingers each having an eyelet to receive a weft thread and being pivotally mounted about a common axis for movement between an inoperative position and an operative position;

(b) Drive means pivotally mounted for movement about said common axis;

(c) Means to impart rotary reciprocating motion to said drive means causing said drive means to repeatedly rock about said common axis, moving first in a driving direction and then back in a return direction;

(d) A plurality of catches, one attached to each of the said fingers;

(e) Control means selectively operable to engage any desired one of said plurality of catches with said drive means so that the rocking movement of said drive means is imparted to the associated finger thereby causing the finger to move from its inoperative position to its operative position as the drive means moves in its driving direction and then back again to its inoperative position as the drive means moves in its return direction.

The mechanism according to the invention employs the minimum possible number of moving parts, and since the catches are attached to the said fingers and the said drive means and the said fingers move about the same axis, then during operation of the mechanism there is no relative movement between the catches and the drive means so there is no rubbing action and hence no wear.

Further advantageous features and details of the invention will become apparent from the following description of one embodiment of the invention, given by way of example.

Figure 1:
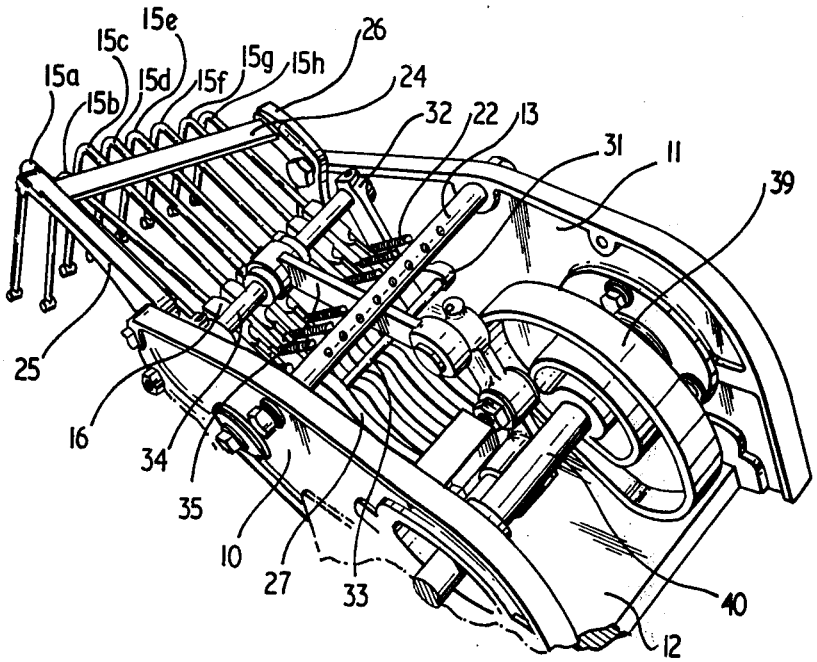
FIG. 1 comprises a perspective view of one embodiment of weft presenting mechanism according to the invention.
Figure 2:
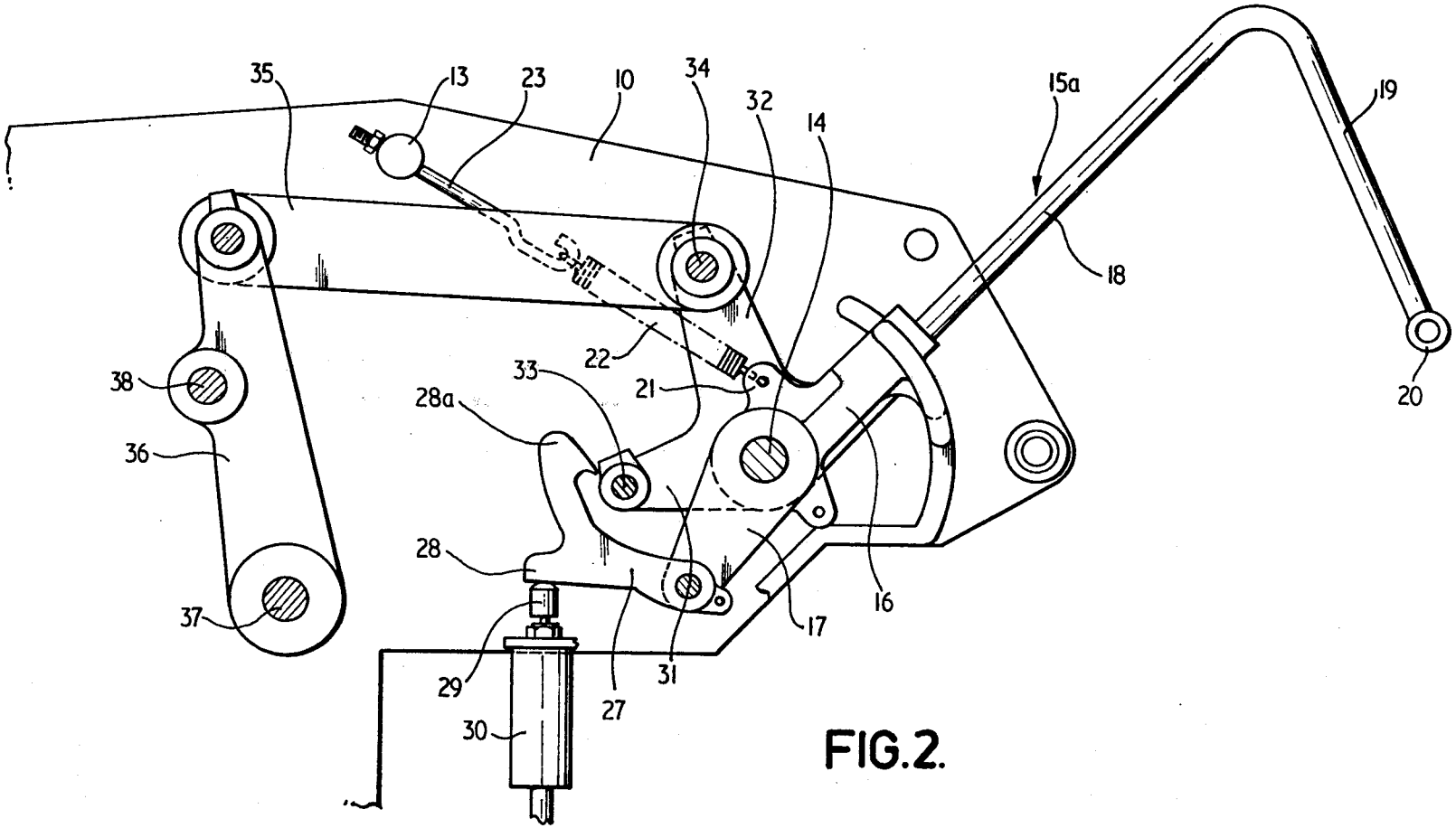
FIG. 2 is a section through the weft presenting mechanism shown in FIG. 1, showing one finger of the mechanism in its inoperative position.
Figure 3:
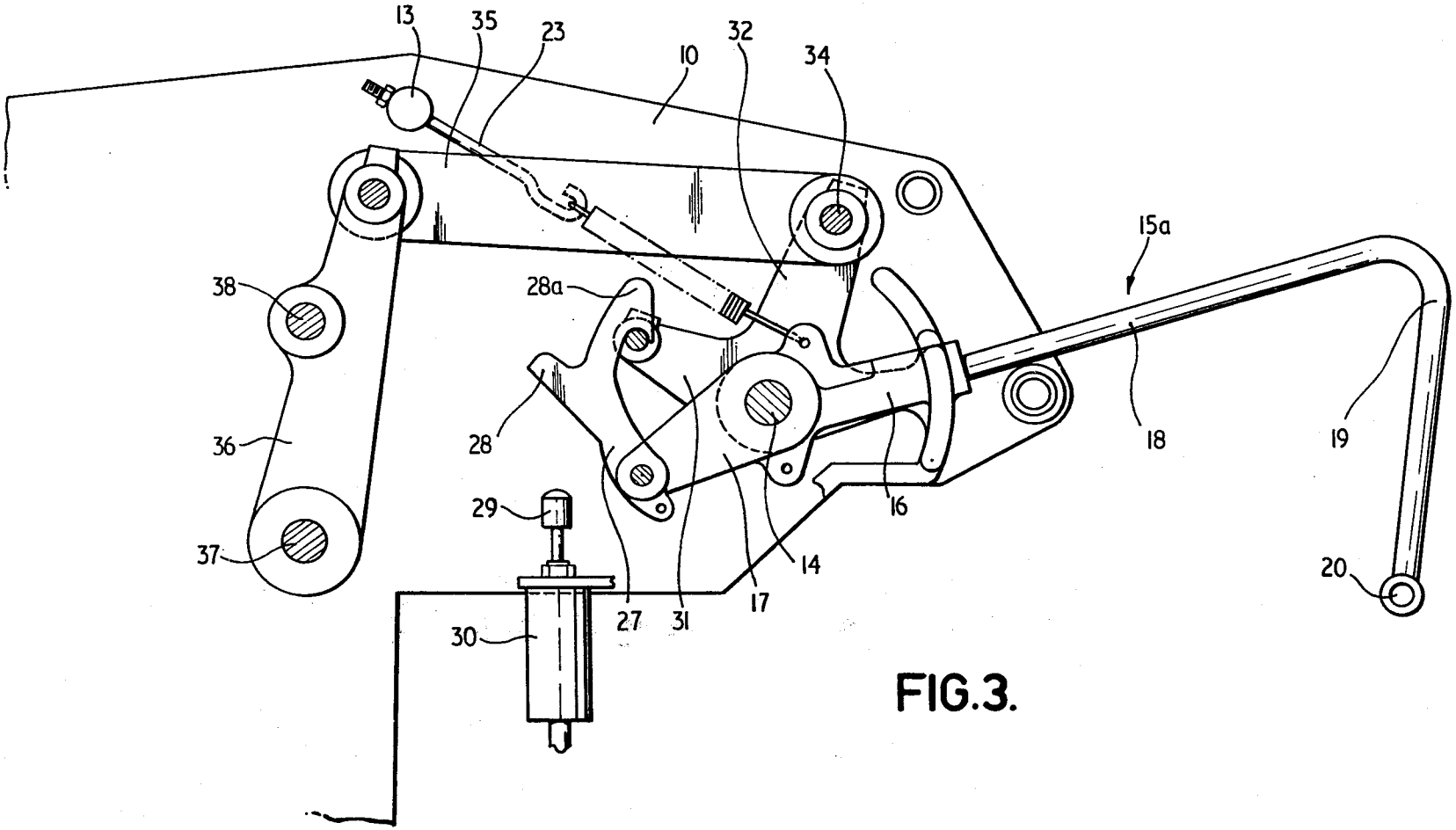
FIG. 3 is a similar view to FIG. 2, but showing the finger in its operative position.

The weft presenting mechanism forming the subject of this embodiment has a housing comprising two side plates 10 and 11 interconnected by a base plate 12 and a cross bar 13. Connected between the side plates 10 and 11 is a shaft which is not visible in FIG. 1 but is indicated in FIGS. 2 and 3 by the reference numeral 14. Mounted for pivotal movement on this shaft 14 is a set of presenter fingers **15*a* to 15*h*. Only one of these fingers 15*a* is shown in FIGS. 2 and 3 for the purposes of illustration. Each finger has an identical butt end comprising a lever having two arms 16 and 17 projecting at opposite sides of the shaft 14. The remainder of the finger comprises a rod 18 secured in the lever arm 16 and having a downwardly angled portion 19 terminating in a ceramic lined eyelet 20. Each finger is pivotable about the shaft 14 between an upper inoperative position as shown in FIG. 2 and a lower operative position as shown in FIG. 3**.

Although the butt ends of the fingers are identical, the lengths of the rods 18 get progressively shorter going from finger **15*a* to finger 15*h* so that as viewed from the side of the mechanism the eyelets 20 do not obstruct one another and when the mechanism is in use the eight different weft threads which will be respectively threaded through the eight eyelets 20 will each be able to run freely from a weft supply to the associated eyelet without being obstructed by other eyelets. The portions 19 are also each correspondingly shorter so that whichever finger is moved into its operative position, its eyelet 20 will always be at the same height, for use in presenting its weft thread to the giver rapier of the loom to which the mechanism is fitted. Each lever arm 16 has a lug 21 thereon and a tension spring 22 is attached to the lug and to a hook 23 secured to the cross bar 13. Thus each finger is biased into its upper inoperative position, the limit of upward movement being defined by a metal strip 24 extending between two arms 25 and 26, arm 25 being attached to side plate 10 and arm 26 being attached to side plate 11**.

At the free end of each lever arm 17 there is pivotally attached a catch in the form of a hook 27. Each hook 27 has a lug 28 projecting thereon and each hook normally rests under the influence of gravity with the associated lug 28 lying on top of the plunger 29 of an associated solenoid 30. There are thus eight hooks 27 and eight solenoids 30. Each hook also has an upwardly projecting nose 28*a*.

Also pivotally mounted on the shaft 14 is a drive unit comprising a pair of bellcrank levers each having a first arm 31 and a second arm 32, one bellcrank lever being mounted adjacent each of the side plates, so that the set of fingers is sandwiched between the bellcrank levers. The free ends of the two arms 31 are interconnected by a first bar in the form of a cylindrical rod 33 and a similar rod 34 interconnects the two arms 32 so that the bellcrank levers and the two rods 33 and 34 can rock about the axis 14 as a single unit. A connecting rod 35 is pivotally fastened to the mid point of the rod 34 and this connecting rod joins the rod 34 to the end of a drive lever 36 which is pivotally mounted on a shaft 37 extending between the side plates 10 and 11. Rotatably mounted on the lever 36 between the shaft 37 and the connecting rod 35 is a cam follower 38. This cam follower 38 engaged in a track in a cam 39 secured to a drive shaft 40 which is mounted in bearings in the side plates 10 and 11.

When the drive shaft 40 receives continuous rotary motion the cam 39 acts on the follower 38 and causes the lever 36 to rock back and forth. This imparts reciprocatory motion to the connecting rod 35, causing the rod 34, bellcrank levers and rod 33 to perform rotary oscillatory motion about the shaft 14, rocking back and forth.

When the mechanism is fitted to a loom, the shaft 40 received continuous rotary motion from the main drive shaft of the loom and as long as the loom is running the bellcrank levers and rods 33 and 34 rock about the shaft 14. As can be seen from FIG. 2, the position of the rod 33 is related to the position of the hooks 27 such that when the hooks are in their rest position the rod 33 moves to and fro past the hooks, without touching them. When it is desired to present any one of the eight weft threads to the giver rapier of a loom to which the mechanism is fitted, the appropriate solenoid 30 is energised causing its plunger 29 to rise to the position shown in FIG. 3. This operation is carried out when the bar 33 has moved into its lowermost position, below the hooked part of the hooks 27. The action of the solenoid moves the associated hook 27 into the path of the rod 33 so when the rod 33 rises again it catches on the hook 27 and takes the hook with it, as shown in FIG. 3. Since the hook is attached to one of the fingers, movement of the hook brings about corresponding movement of the finger so that the desired weft is moved into the path of the giver rapier. The position of weft presentation is shown in FIG. 3, the rod 33 having reached the limit of its clockwise movement as viewed in FIG. 3.

Although the plunger 29 of the solenoid 30 is still shown as raised in FIG. 3, for the purposes of illustration, the solenoid is in fact deactuated as soon as the hook 27 has engaged with the rod 33 so that the plunger 29 returns to the position shown in FIG. 2. Thus as soon as the rod 33 returns to its lowermost position as shown in FIG. 2, the hook 27 falls off the rod under the influence of gravity and centrifugal force and the hook and associated finger does not therefore perform any further movement until the associated solenoid is once again actuated.

During any particular weaving operation the eight solenoids 30 can be operated in any desired sequence, as many times as is desired, by conventional control means such as a set of electrical switches controlled by punched tape.

Since each hook 27 is connected to one of the fingers, and the fingers and the bellcrank levers rock about the same shaft 14, it will be seen that during the movement of the fingers between their movement from their inoperative position to their operative position and back again, there is no relative movement between the hooks 28 and the rod 33, so there is no rubbing action and the hooks are not subject to wear.

The invention is not restricted to the details of the foregoing embodiments. For instance the timing of the solenoids 30 may be altered. The method of operating the apparatus described above requires very precise timing, because the solenoid plunger must reach its uppermost position as soon as the rod 33 reaches its lowermost position and it may be difficult to achieve this if there are wide tolerances on the operating time of electrical switches controlling the solenoids and on the response time of the solenoids. To avoid this difficulty the solenoids may be actuated early, while the rod 33 is in its uppermost position as shown in FIG. 3, or during the period while the rod 33 is moving downwardly. This early actuation of the solenoids does not cause the hooks to move underneath the rod 33 and jam, since the nose 28*a* on each hook prevents this by abutting against the rod 33. In other words whenever a hook is moved by a solenoid it moves into the path of the rod 33 and presses against the rod, but does not pass underneath it. The rod then forces its way past the hook, pushing the hook back slightly against the action of the solenoid. As soon as the rod 33 has moved downwardly past the hooked portion of the hook, the action of the solenoid snaps the hook over the top of the rod, so that when the rod returns it catches on the hook and moves it into the position shown in FIG. 3, the remainder of the cycle continuing as previously described.

I claim:

1. A weft presenting mechanism for use on a loom, the mechanism comprising:

(a) a plurality of fingers each having an eyelet to receive a weft thread and being pivotally mounted about a common axis for movement between an inoperative position and an operative position;

(b) drive means pivotally mounted for movement about said common axis, said drive means comprising a pair of bellcrank levers, one mounted at each side of the plurality of fingers, so that the fingers are sandwiched therebetween, a first bar extending between one arm of each lever and a second bar extending between the other arm of each lever;

(c) means connected to said second bar to impart rotary reciprocating motion to said bellcrank levers causing said first bar to repeatedly rock about said common axis, moving first in a driving direction and then back in a return direction;

(d) a plurality of catches, one attached to each of the said fingers, each catch comprising a hook; and (e) control means selectively operable to move any desired hook into the path of the said first bar so that as the said first bar moves past the hook in its driving direction it catches on the hook and moves the hook and attached fingers with it, the rocking movement of the said first bar thus being imparted to the associated finger thereby causing the finger to move from its inoperative position to its operative position as the first bar moves in its driving direction and then back again to its inoperative position as the first bar moves in its return direction.

2. A weft presenting mechanism according to claim 1, in which the hooks are biased out of the path of the drive means, but can be selectively moved into the path of the drive means against the action of the bias by the control means.

3. A weft presenting mechanism according to claim 2, in which the hooks are biased out of the path of the drive means at least in part by gravity.

4. A weft presenting mechanism according to claim 2, in which the hooks are biased out of the path of the drive means at least in part by centrifugal force.

5. A weft presenting mechanism according to claim 2, in which the control means comprises a plurality of selectively operable plungers, one associated with each hook and operable to move from an inoperative position to an operative position in which it holds the associated hook in the path of the drive means.

6. A weft presenting mechanism according to claim 5, in which each plunger comprises a solenoid.

7. A weft presenting mechanism according to claim 5, in which each plunger is arranged to return subsequently to its inoperative position so that when the drive means moves in its return direction any hook engaged with the drive means is freed and is able to move out of the path of the drive means under the action of its bias.

8. A weft presenting mechanism according to claim 1, in which the said means to impart reciprocatory motion comprises a lever mounted on a shaft, a connecting rod connecting the lever to the said second bar, a follower mounted on the lever, and a rotary cam in engagement with the follower, continuous rotary motion of the cam in one direction causing the lever to reciprocate back and forth and impart rotary movement to the drive means via the lever and connecting rod.

9. A weft presenting mechanism according to claim 1, in which each finger is biased into its inoperative position by spring means.

* * * * *